US006695220B2

(12) United States Patent
Vollmer

(10) Patent No.: US 6,695,220 B2
(45) Date of Patent: Feb. 24, 2004

(54) POWDER SPRAY COATING SYSTEM

(75) Inventor: David J. Vollmer, Grand Haven, MI (US)

(73) Assignee: Herman Miller, Inc., Zeeland, MI (US)

( * ) Notice: Subject to any disclaimer, the term of this patent is extended or adjusted under 35 U.S.C. 154(b) by 36 days.

(21) Appl. No.: 10/041,939

(22) Filed: Jan. 7, 2002

(65) Prior Publication Data

US 2002/0109018 A1 Aug. 15, 2002

Related U.S. Application Data

(60) Provisional application No. 60/260,997, filed on Jan. 11, 2001.

(51) Int. Cl.[7] ..... A62C 5/02; A62C 31/00; A62C 5/00; B05B 5/00; F23D 11/32

(52) U.S. Cl. ..... 239/8; 239/690; 239/695; 239/305; 239/311

(58) Field of Search ..... 239/8, 690, 695, 239/305, 311, 304, 303, 307, 308, 325, 104, 106, 112

(56) References Cited

U.S. PATENT DOCUMENTS

| | | | | |
|---|---|---|---|---|
| 3,672,570 A | | 6/1972 | Scarbrough et al. | |
| 3,674,205 A | | 7/1972 | Kock | |
| 3,782,632 A | * | 1/1974 | Braun et al. | 239/112 |
| 3,924,810 A | * | 12/1975 | Otterstetter | 239/305 |
| 4,170,074 A | | 10/1979 | Heckman et al. | |
| 4,248,379 A | | 2/1981 | Hollstein et al. | |
| 4,302,481 A | | 11/1981 | Ribnitz et al. | |
| 4,590,884 A | | 5/1986 | Kreeger et al. | |
| 4,728,033 A | | 3/1988 | Matsumura et al. | |
| 4,730,647 A | | 3/1988 | Mulder | |
| 4,746,063 A | | 5/1988 | Roberts | |
| 4,770,344 A | | 9/1988 | Kaiser | |
| 4,823,731 A | | 4/1989 | Howeth | |
| 4,824,295 A | | 4/1989 | Sharpless | |
| 4,898,116 A | | 2/1990 | Kozoe et al. | |
| 4,953,495 A | | 9/1990 | Salisbury | |
| 4,957,060 A | | 9/1990 | Cann | |
| 5,018,909 A | | 5/1991 | Crum et al. | |
| 5,080,289 A | | 1/1992 | Lunzer | |
| 5,107,756 A | | 4/1992 | Diaz | |
| 5,136,972 A | | 8/1992 | Naka et al. | |
| 5,170,591 A | | 12/1992 | Brielmaier et al. | |
| 5,215,261 A | | 6/1993 | Frene | |
| 5,256,201 A | | 10/1993 | Gelain et al. | |
| 5,288,324 A | | 2/1994 | Shaneyfelt | |
| 5,389,149 A | | 2/1995 | Carey et al. | |
| 5,591,240 A | | 1/1997 | Ophardt et al. | |
| 5,645,380 A | | 7/1997 | Rutz | |
| 5,704,957 A | | 1/1998 | Rutz | |
| 5,739,429 A | | 4/1998 | Schmitkons et al. | |
| 5,743,958 A | * | 4/1998 | Shutic | 118/308 |
| 5,776,249 A | | 7/1998 | Rutz | |
| 6,112,999 A | | 9/2000 | Fingleton et al. | |
| 6,223,997 B1 | * | 5/2001 | Fulkerson et al. | 239/112 |
| 6,264,113 B1 | | 7/2001 | Dingler | |
| 6,315,214 B1 | * | 11/2001 | Fingleton et al. | 239/8 |

* cited by examiner

*Primary Examiner*—Gene Mancene
*Assistant Examiner*—Darren Gorman
(74) *Attorney, Agent, or Firm*—Brinks Hofer Gilson & Lione

(57) ABSTRACT

A powder spray system comprises a plurality of supply hoppers, a purge air supply, a manifold operably connected to each of the plurality of supply hoppers, and a spray gun. The manifold comprises a plurality of outlets. The spray gun is operable in a plurality of spraying configurations and a purging configuration. The spray gun is selectively, removably connected to at least one of the outlets when in one of the plurality of the spraying configurations and is removably connected to the purge air supply when in the purging configuration. A method of operating a powder spray system also is provided.

20 Claims, 4 Drawing Sheets

60
64
62
66
56
66
100
HT
HT
94
82
52
54
LT
LT
94
82
LU
LU
94
82
SG
SG
56
52
HF
HF
92
66
LG
LG
54
82
94
JT
JT
BU
BU
88
MT
MT
82
94
MS
MS
82
II
II
94
12
98
96
72

POWDER SPRAY COATING SYSTEM

This application claims the benefit of U.S. Provisional Application Serial No. 60/260,997, filed Jan. 11, 2001, the entire disclosure of which is hereby incorporated by reference.

BACKGROUND

The present invention relates generally to a powder spray coating system, and in particular, to a quick-change powder spray coating system.

Powder spray coating systems are commonly used to powder coat various consumer products, typically metal, wood or plastic, such as office furniture, including for example storage units, and other general industrial powder coat applications, including for example, various automotive products and the like. In order to maintain smaller inventories while at the same time providing a wide selection of colors to the end user, it often is necessary and desirable to change the color being applied to one or more products several, dozens or even hundreds of times during a typical eight-hour shift. Typically, a hopper is used to supply the powder to one or more spray guns being used to apply the powder. When a color change is desired, the operator ordinarily is required to purge the powder supply lines and vent tubes connected to a supply hopper so that residue powder in the lines does not contaminate the next color, or product being sprayed therewith. The operator then must disconnect the various air lines, fluidizing lines, vent tubes, and powder hoses from the hopper and reconnect the various lines and hoses to a new hopper. Even with skilled operators, such changes can take several minutes.

To avoid some of the difficulties associated with color changes, some manufacturers use a different, dedicated paint line and spray gun for each color. However, many manufacturers run ten or more colors, which can thereby prohibitively increase the expense and space required to maintain such equipment.

Other manufacturers have developed systems that provide a plurality of supply hoppers feeding one or more spray guns, as shown for example in U.S. Pat. No. 6,112,999. Such systems, however, require the powder supply line to be disconnected from the gun and back purged to the supply hopper. However, if residue from a different color remains in the line, it may be purged back into the supply hopper, thereby contaminating the entire hopper. Moreover, such systems do not provide for the spray gun to be purged, which also can lead to contamination when the spraying operation is resumed. Moreover, such systems incorporate complicated control systems, which can be expensive to construct, maintain and operate.

BRIEF SUMMARY

Briefly stated, in one aspect of the invention, one preferred embodiment of a powder spray system comprises a plurality of supply hoppers, a purge air supply, a manifold operably connected to each of the plurality of supply hoppers, and a spray gun. The manifold comprises a plurality of outlets. The spray gun is operable in a plurality of spraying configurations and a purging configuration. The spray gun is selectively, removably connected to at least one of the outlets when in one of the plurality of the spraying configurations and is removably connected to the purge air supply when in the purging configuration.

In a preferred embodiment, the spray gun comprises a hose that extends therefrom and terminates in an open end.

The open end is selectively, removably connected to at least one of the plurality of outlets when the spray gun is in the spraying position. The open end is removably connected to the purge air supply when the spray gun is in the purging position.

Also in a preferred embodiment, the system further includes at least one main air supply connected to the manifold and a plurality of air supply lines connecting the plurality of supply hoppers and the manifold. The manifold further comprises a plurality of valves each moveable between at least an open position and a closed position. The plurality of valves correspond to and are operably connected to the plurality of air supply lines. The main air supply communicates with at least one of the supply lines, and preferably two supply lines, when at least one of the valves corresponding to that supply line or lines, and preferably a set of valves, is in the open position.

In another aspect of the invention, a fluidizing air supply is connected to each of said plurality of supply hoppers. A vent box comprises a plurality of inlets connected to the plurality of supply hoppers.

In yet another aspect of the invention, a method of operating a powder spray system includes connecting the spray gun to one of the plurality of outlets, supplying air to one of the supply hoppers associated with the selected outlet connected to the spray gun, and spraying powder from the supply hopper. The method further includes disconnecting the spray gun from the selected outlet, connecting the spray gun to a purge air supply and purging the spray gun with the purge air supply. The spray gun is then connected to another of the plurality of outlets.

The present inventions provide significant advantages over other powder coating systems and methods for applying powder coating. For example, the system provides for a plurality of supply hoppers to be operably connected to a manifold. As such, individual hoppers do not have to be disconnected and removed after each color change cycle. Rather, one or more valves, preferably two, can be quickly and easily turned to isolate any particular hopper. In addition, the spray gun can be quickly removed from its connection with any one hopper. The spray gun, and any line extending therefrom, can be quickly purged between color changes so as to avoid contaminating either the next product to be sprayed and/or the supply hoppers. The spray gun can then be operably reconnected to the next hopper for a new spraying cycle with a new color. As such, the system avoids back purging, which can contaminate the supply hoppers, while at the same time allowing for the spray gun to be purged. The system is simple and robust and does not require expensive and difficult to maintain control systems. In addition, color changes can be effected by a single operator in about 10 seconds, or even less, with minimal waste and no risks of contamination.

The vent box, with its plurality of inlets, also provides significant advantages. In particular, it allows one or more supply hoppers to be vented to a single location. At the same time, all of the hoppers can be fluidized, even when not in use. As such, construction, maintenance and operation costs are reduced.

The present invention, together with these and other advantages, will be best understood by reference to the following detailed description taken in conjunction with the accompanying drawings. The foregoing paragraphs have been provided by way of general introduction, and should not be used to narrow the scope of the appended claims.

DETAILED DESCRIPTION OF THE PRESENTLY PREFERRED EMBODIMENTS

Figure 1:
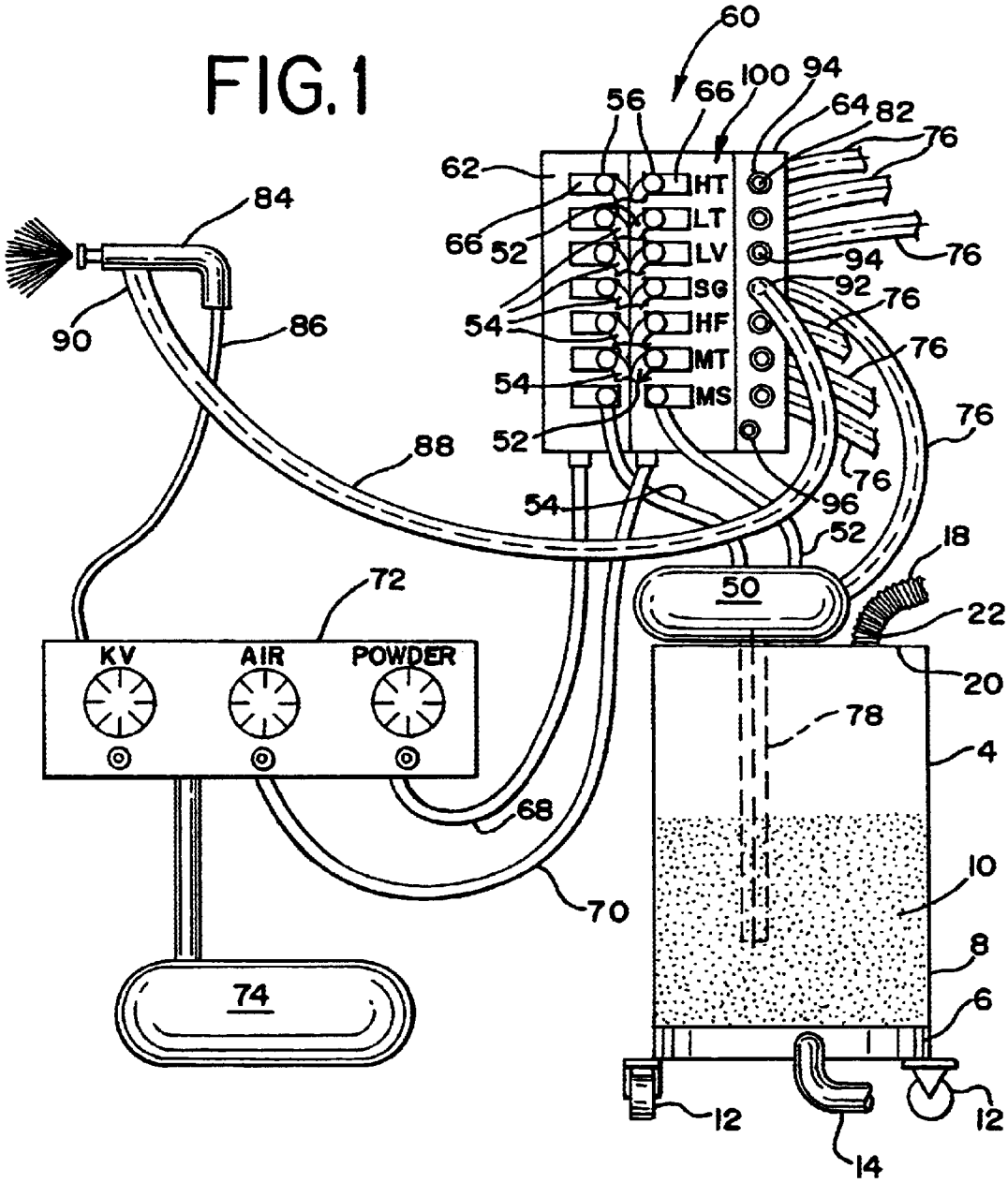
FIG. 1 is a schematic view of a powder coating spray system.

Referring to FIG. 1, a powder coating spray system 2 includes a powder supply hopper 4 having an upper portion 8 defining an interior space, at least a portion of which is filled with a powder 10, and a lower portion 6. The supply hopper 4, including the upper and lower portions, is preferably cylindrical and is preferably supported by a plurality of wheels that allow for the supply hopper to be portable and easily moveable from one location to the next. The hopper can be filled through a hatch 21 formed in an upper wall 20 of the hopper, or the entire upper wall, which is releasably attached to the upper portion with clamps, can be removed from the hopper to facilitate the cleaning thereof. Although only one supply hopper 4 is illustrated in FIG. 1 for the sake of simplicity, it should be understood that in the preferred embodiment, a plurality of supply hoppers are incorporated into the system, as shown for example in FIG. 3 and as further explained herein below. A fluidizing airline 14 is connected to the lower portion 6 of the supply hopper, which receives a fluidizing air supply that passes from the lower portion to the upper portion through a porous filter/wall separating the two portions into different chambers. The fluidizing air maintains the powder 10 in a fluidized state within the upper portion 8. Preferably, the fluidizing air is maintained at a pressure of from about 2 to about 50 psi, and more preferably at about 7 psi.

As best shown in FIGS. 1 and 3–5, a vent tube 18 includes a first end 22 connected to the upper wall 20 of the upper portion of the supply hopper and a second end 24 connected to an inlet 26 of a vent box 30. The vent box includes a front wall 32 having a plurality of inlet tubes 26 or insert members extending outwardly therefrom and defining a plurality of inlet openings 28. The inlet tube 26 is inserted into the end 24 of the vent tube 18, although it should be understood that the vent tube and inlet could be configured such that the vent tube is inserted into the inlet. The inlet tube 26 preferably has a diameter of about 2 inches. The number of inlets preferably corresponds to or is greater than the number of supply hoppers associated therewith. The term "plurality" means two or more. It should be understood that the number of twelve inlets is meant to be illustrative, and that the vent box could have more or less inlets depending on the number of supply hoppers used. For example, the vent box could have as few as two inlets and as many as a hundred, or even more. Alternatively, it should be understood that one or more of the inlets can be blocked or closed when not connected to a supply hopper.

The vent box 30 preferably has a top 34, bottom 36 and rear wall 38 and opposite side walls 40 defining a chamber 42. The side walls 40 include a front portion 44 extending substantially perpendicular from the front wall and a rear portion 46 angled between the front portion 44 and the rear wall 38 such that the vent box narrows. The vent box is preferably supported by or connected to a frame, for example, by fastening a portion of the front wall, which may include tabs, to the frame. The various walls are preferably made of sheet metal, preferably 18–20 gauge, and are formed to define a chamber 42 with air-tight seams. A pair of outlet tubes 48 extend outwardly from the rear portion 46 of the side wall and are connected to a powder booth collector, which collects any excess powder vented from the supply hoppers. It should be understood that a single outlet, or some number more than two outlets, can be used to evacuate the vent box. An air supply is applied to the outlet tubes to draw the vented fluidization air from the vent box. In particular, a ventilation assist coupling 41 can be manipulated to change the flow rate through the outlet tubes by introducing an air pressure of preferably between about 50 psi and about 100 psi, and more preferably at about 70 psi. Preferably, the air flow in the outlet applies a negative pressure of from about 1 psi to about 10 psi to the vent box 30 to vent excess fluidization air from the supply hoppers while minimizing the amount of powder lost through the vent tube 18. It should be understood that a positive pressure also could be applied to the vent box by way of the supply hoppers or otherwise.

Figure 2:
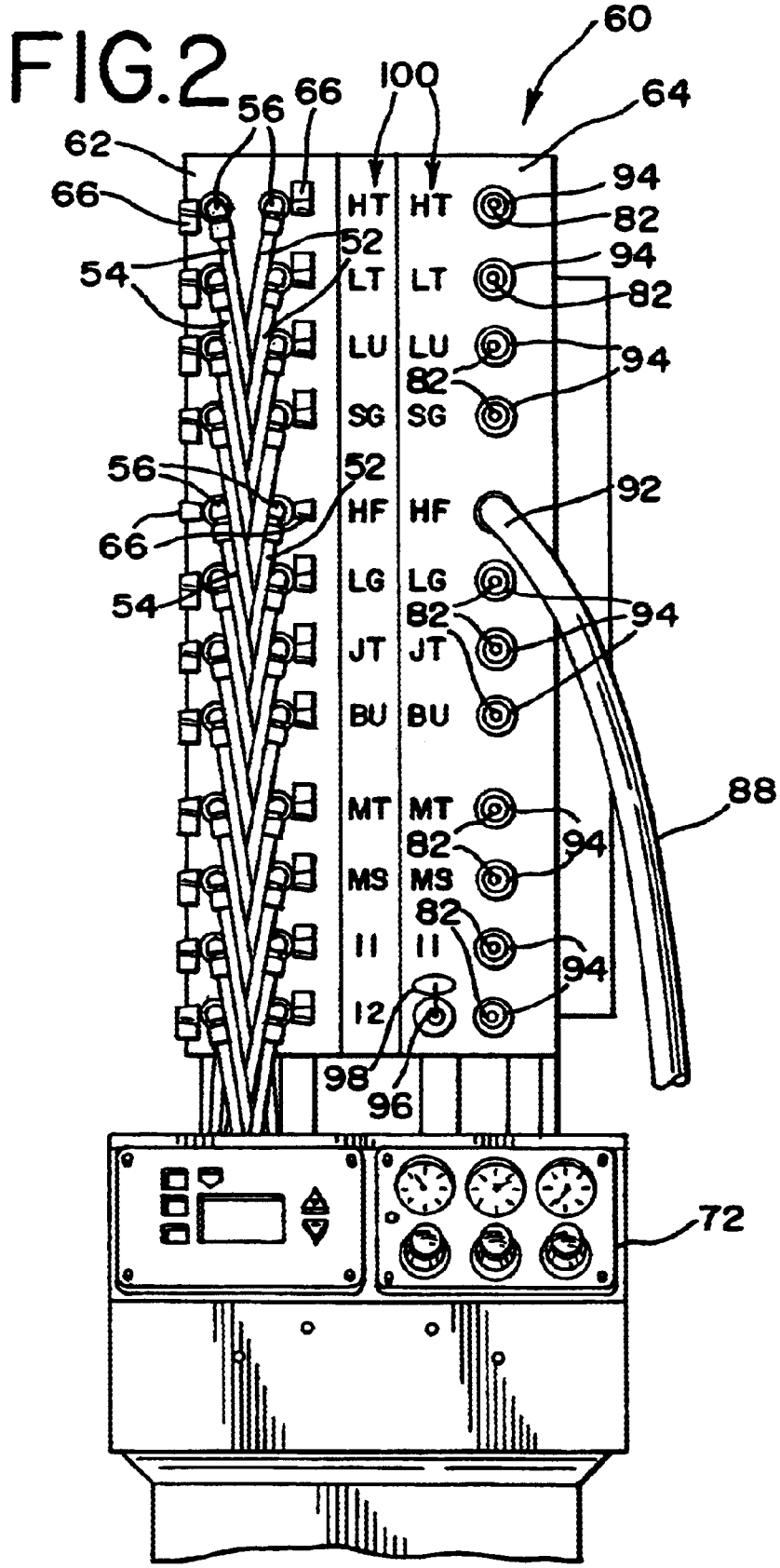
FIG. 2 is a partial front view of the powder coating spray system, including a manifold.
Figure 3:
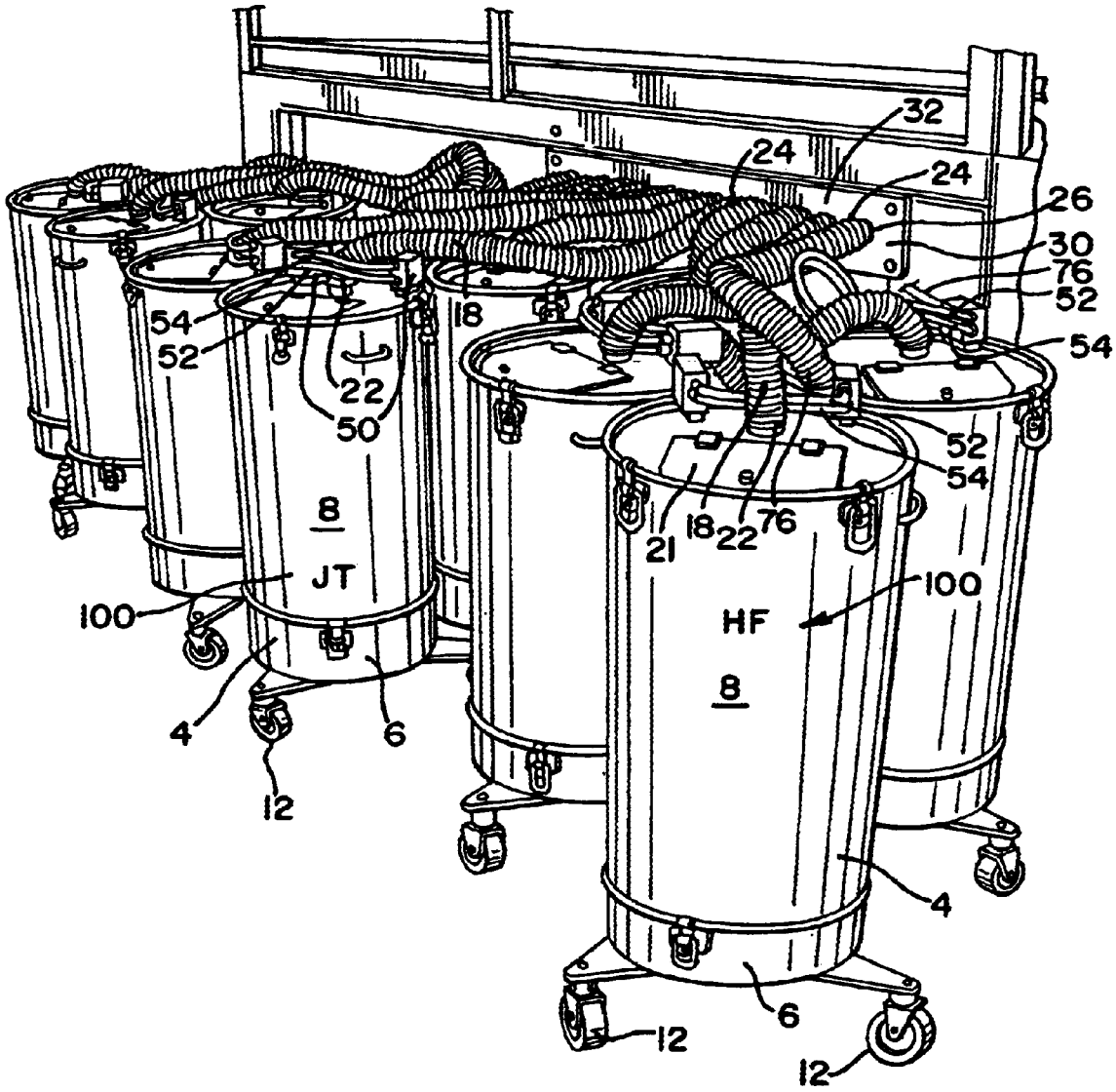
FIG. 3 is a partial perspective view of the powder coating spray system, including a plurality of supply hoppers connected to a vent box.
Figure 4:
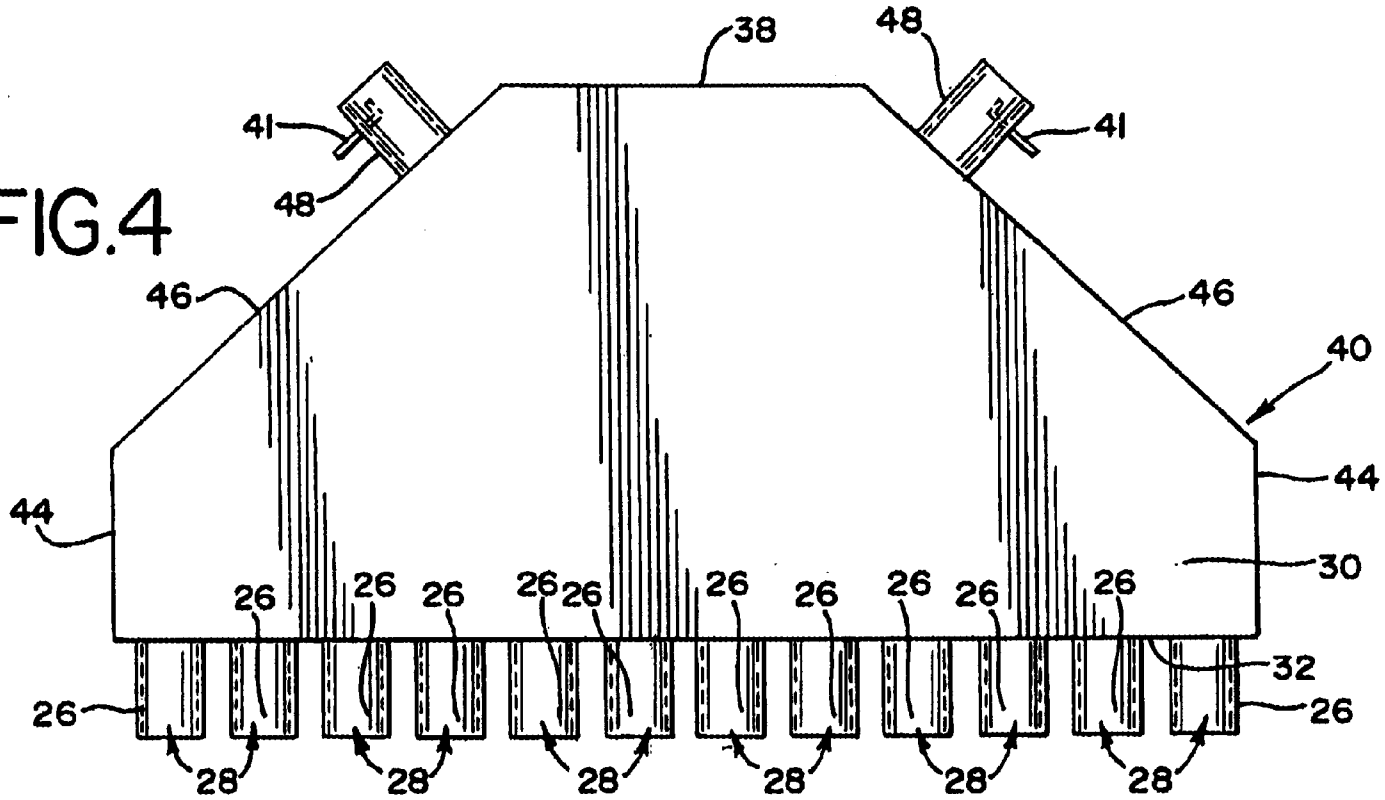
FIG. 4 is a top plan view of a vent box.
Figure 5:
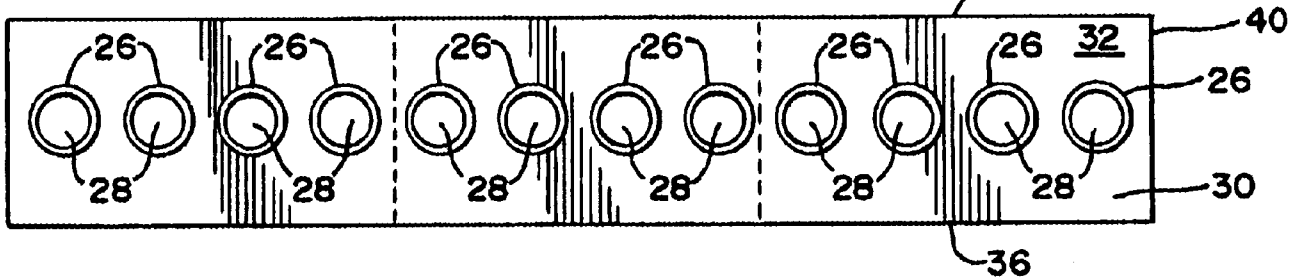
FIG. 5 is front view of the vent box.

Referring to FIGS. 1–3, one or more pumps 50 are mounted on top of the supply hopper 4. One acceptable commercially available pump is the Nordson 100 Plus pump available from Nordson Corp. The number of pumps 50 connected to each hopper preferably corresponds to the number of spray guns to be connected to the supply hopper. For example, as shown in FIG. 3, a pair of pumps 50 is connected to each supply hopper 4. A pair of air supply lines 52, 54 interconnect one of the pumps on the supply hopper and a pair of couplings 56 or fittings located on a supply manifold 62, which comprises part of an overall color change manifold 60. Preferably the air supply lines have a ¼ inch internal diameter. The other supply hoppers (not shown in FIG. 1) are likewise connected to other pairs of couplings 56 located on the manifold 62 with supply lines 52, 54 (partially shown), such that the manifold 62 is connected to the plurality of supply hoppers being used in the system. A valve 66, preferably a ¼ inch mini ball valve available from West Michigan Rubber Supply Corp., is operably connected to each coupling and is moveable between an open and closed position so as to permit air to flow into the air supply lines from the manifold 62. Preferably, the valves for each pair of air supply lines connected to any particular supply hopper are arranged horizontally on the manifold 62, with the valves associated with different pairs of air supply lines and corresponding supply hoppers arranged vertically on the manifold 62. Alternatively, a single valve assembly may be actuated to open both supply lines simultaneously.

A pair of main air supply lines 68, 70 are connected to the bottom of the manifold 62 and supply air to each of the air supply lines when the preferably ¼ inch valve 66 corresponding to line is in the open position. The manifold 62 is preferably made of aluminum and preferably includes two internal passageways communicating with the two columns of vertically aligned valves and the main air supply lines. In this way, each main air supply line provides an air supply to each of the air supply lines communicating with that passageway of the manifold when the valve corresponding to, or operably connected with, that particular air supply line is opened. The main air supply lines 68, 70 are connected to a high-voltage control box 72, which regulates the pressure in each of the lines. An air compressor 74 is connected to the control box and supplies air to the main air supply lines. A first main air supply line 68, and air supply line 54 connected to one of the supply hoppers via the pump 50, provides an air flow to the pump sufficient to provide an venturi effect, or lowering of pressure by way of increased velocity, to draw fluidized powder into the air stream traveling into a powder supply line 76, which connects the pump to an outlet manifold 64. Preferably, the pressure in the supply lines 68, 54 is from about 20 psi to about 70 psi and preferably at about 60 psi. The other main supply air line 70 provides an additional volume of air that creates a desired total air flow in the powder supply line 76. Preferably, the pressure in the supply line 70 is from about 10 psi to about 40 psi, and more preferably at about 25 psi. Preferably the pressure in the powder supply line 76, when the pump is activated, is from about 5 psi to about 10 psi and more preferably at about 7 psi.

As shown in FIG. 1, a draw line 78 extends from the pump 50 into the supply hopper 4. The fluidized powder 10 is drawn through the draw line 78 and into the powder supply line 76. The pump 50 is activated by the air flow entering the pump via the supply lines 52, 54 as the valves 66 associated with those lines are opened to allow the air supply lines to communicate with the main air supply via the manifold 62. The amount of pressure in the air supply lines 68, 70 is controlled by the user using various gauges, valves and controllers making up part of the control box 72. It should be understood that other supply hopper and pump configurations can be used without departing from the scope of this invention.

The powder supply line 76 extends from the supply tank 4 and includes an end 80 that is connected with an outlet manifold 64, which comprises another part of the color change manifold 60. It should be understood that the outlet manifold 64 can be constructed as a separate outlet manifold unit, but is preferably integrally formed as part of the overall color change manifold 60. The outlet manifold 64 includes a plurality of outlets 82, with each outlet 82 connected to and associated with one of the plurality of supply hoppers via a corresponding powder supply line 76. It should be understood that the number of twelve outlets 82, twelve sets or pairs of valves 66, and twelve sets of supply lines 52, 54, as shown in FIG. 2, is meant to be illustrative rather than limiting, and that manifolds can have more or less numbers of these components, for example as few as two and as many as a hundred or even more, depending on the desired number of supply hoppers incorporated into the system. Of course, it also should be understood that if the number of hoppers being used in the system is less than the capacity of the system, one or more of the outlets on the outlet manifold can simply be left open or free, without any connection to any powder supply line. Likewise, one or more pairs of valves, couplings and/or supply lines can simply be left without any connection to a supply hopper, with the not-in-use valves preferably placed in the closed position.

Referring to FIG. 1, a spray gun 84 is connected to the control box 72 with a high-voltage cable 86. The control box 72 and spray gun 84 are configured to electrostatically charge the powder as it leaves the spray gun. The amount of electrostatic change applied by the gun 84 is controlled by the user via the control box 72. One commercially available spray gun is the Surecoat spray gun available from Nordson Corp. Other types of spray guns, and the associated charging thereof, are well known in the art without further description.

A supply hose 88 has a first end 90 operably connected to the spray gun and a second opposite free end 92 having an opening. The free end 92 is shaped to be received on the outlet tubes 94, or coupling insert, extending from the outlet manifold 64. The hose 88 is preferably made of rubber, or another flexible material, and forms a friction fit with the outlet coupling 94, which is inserted into the open end, so as to hold the hose 88 on the outlet tube. One suitable supply hose is available from Nordson Corporation. It should be understood that the hose and outlet tube could be configured such that the hose is received in the tube.

Referring to FIGS. 1 and 2, a purge air nipple 96 extends from the outlet manifold. A valve 98, which is moveable between at least an open and closed position, controls the purge air supply exiting the purge air nipple.

As shown in FIG. 2, indicia 100 are located adjacent each pair of valves 66 and each outlet tube 94 associated with a particular supply hopper. The indicia 100 indicate to the operator the color of the powder 10 located in that particular supply hopper. The hoppers are preferably marked with like indicia so as to facilitate the hook-up, re-supply and/or change-over process when the hopper is emptied. For example, the indicia HT designates an Inner Tone Light color. It should be understood that the indicia on the manifolds and supply hoppers can be any alpha-numeric character, word, phrase, symbol, pictorial or other designation that is associated with any particular color used by the operator.

It should be understood that each spray gun 84 preferably has an associated supply and output manifold 62, 64 associated therewith. Accordingly, if two spray guns are being operated together, a pair of manifolds 60, each preferably including a supply manifold 62 and an outlet manifold 64 configured integrally or as separate units, with an associated plurality of air supply lines 52, 54, pumps 50 and powder supply lines 76, will be connected to each of the plurality of supply hoppers. In this way, a single supply hopper, or set of hoppers, can simultaneously supply a plurality of spray guns via a corresponding plurality of manifolds 60, each preferably including a supply manifold 62 and an outlet manifold 64 configured integrally or as separate units. For example, if two spray guns 84 are used, each supply hopper 4 will preferably have two pumps 50, each of which is connected to a pair of air supply lines 52, 54 and a powder supply line 76. Each pair of air supply lines 52, 54 and the powder supply line are in turn connected to a different manifold 60, which preferably includes a supply manifold 62 and an outlet manifold 64 configured integrally or as separate units, each of which manifolds 60 is associated with one of the two spray guns. At the same time, a single control box can supply the main air supply and high voltage charge to the plurality of manifolds and spray guns respectively, although a plurality of control boxes also can be used.

In operation, with reference to FIGS. 1 and 2, the operator determines which color will be run, or will be sprayed by the spray gun 84 associated with one particular manifold 60. The free end 92 of the supply hose 88 is connected to the outlet tube 94 on the outlet manifold 64 that is associated with that particular color, preferably by referring to the indicia 100 located on the outlet manifold 64. The operator then opens the valves 66 connected to the air supply lines 52, 54 supplying air to the supply hopper 4 associated with that particular color via the pump 50, again by preferably referring to the indicia 100 located on the supply manifold 62. In one preferred embodiment, the indicia 100 are located between each outlet tube 94 and the valves 66 associated with the supply hopper connected to that outlet, so as to provide indicia for both aspects. Preferably, the outlet 82 connected to a particular supply hopper 4 is arranged horizontally adjacent the pair of valves 66 controlling the air supply to that same hopper. In addition, the combinations of outlets 82 and valves 66 corresponding to each of the hoppers are preferably arranged vertically on the manifolds. Of course, it should understood that the outlets and associated valves for each individual hopper could be arranged vertically adjacent each other, with the combinations of outlet and valves associated with each hopper arranged horizontally, with appropriate indicia located adjacent the outlets and valves respectively.

As the valves are opened, the air supply in the air supply lines 52, 54 activates the pump 50, which draws fluidized powder from the supply hopper into the powder supply line. For example, as shown in FIG. 2, the valves 66 associated with the color associated with the indicia HF are open, while the remaining valves are closed. Likewise, the end 92 of the hose 88 is connected with the outlet 82 associated with the color designated by the indicia 100 of HF. The pressurized, fluidized powder 10 flows through the powder supply line 76 and into the powder supply hose 88 connected to the outlet tube 94 and thereafter to the spray gun 84. The operator can then actuate the spray gun 84, directly or remotely, to spray charged powder particles onto the desired object. Preferably, the object is made of metal, although it can also be made of wood or plastic. For example, the operator can powder coat various furniture components, such as storage units. However, it should be understood that the system is not limited to use in the furniture industry, but can be used for any general industrial powder coat application, including for example and without limitation the automotive industry.

If a color change is desired, the operator simply closes the pair of valves 66 and thereafter removes the free end 92 of the supply hose from the outlet 82. The free end 92 is then disposed on the purge air supply nipple 96, which is preferably configured as a male barbed fitting that frictionally engages the end of the hose 88. The purge valve 98 is opened and the hose 88 and spray gun 84 are purged with a purge air supply, preferably for a period of about 5 seconds. The operator then closes the purge air supply valve 98, removes the free end 92 and disposes it on another outlet tube 94 associated with the next selected color to be sprayed. The valves 66 associated with the air supply lines 52, 54 connected to the corresponding supply hopper 4 are then opened such that spraying can resume. The outlet 94 and valves 66 are preferably selected by referring to the indicia 100 located on one or both of the manifolds 62, 64.

In addition, the supply hoppers 4 are maintained in a fluidized state, as they are vented to the vent box 30, and do not have to be disconnected and/or reconnected for each color change. Rather, each supply hopper is connected to one or more manifolds 62, 64 by way of dedicated lines 52, 54, 76 that do not have to be purged and which are therefore not susceptible to contamination. Instead, only the powder supply hose 88 and spray gun 84 have to be purged between color changes. Such purging can be performed quickly and simply by actuating the purge air supply valve 96. Since the powder supply hose 88 is relatively short, preferably having a length of between about 4 feet and 10 feet, the powder waste produced during each purge cycle is minimal. At the same time, back purging to the supply hoppers, which can contaminate the entire supply of powder in each hopper, is avoided. In operation, a single operator can make a color change in about 10 seconds.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A powder spray system comprising:

a plurality of supply hoppers;

a purge air supply;

a manifold operably connected to each of said plurality of supply hoppers, said manifold comprising a plurality of outlets; and a spray gun operable in a plurality of spraying configurations and a purging configuration, wherein said spray gun comprises a hose extending therefrom and terminating in an open end, wherein said open end is moveable between at least one first connection, wherein said open end is selectively, removably connected to at least one of said plurality of outlets when said spray gun is in said spraying configuration, and a second connection, wherein said open end is removably connected to said purge air supply when said spray gun is in said purging configuration, and wherein said open end is free floating and free of any connection to said manifold when being moved between said at least one first connection and said second connection.

2. The system of claim 1 further comprising a plurality of pumps connected to said plurality of said supply hoppers and a plurality of air supply lines connecting said plurality of said pumps and said manifold.

3. The system of claim 2 further comprising at least one main air supply connected to said manifold.

4. The system of claim 3 wherein said manifold comprises a plurality of valves each moveable between at least an open position and a closed position, wherein said plurality of said valves correspond to and are operably connected to said plurality of said air supply lines, and wherein said at least one main air supply communicates with at least one of said air supply lines when at least one of said valves corresponding to said at least one of said air supply lines is in the open position.

5. The system of claim 4 wherein said at least one main air supply comprises a pair of main air supplies.

6. The system of claim 1 further comprising a plurality of powder supply lines connecting said plurality of said supply hoppers and said manifold.

7. The system of claim 6 further comprising a plurality of pumps operably connected between said plurality of said supply hoppers and said plurality of said powder supply lines.

8. The system of claim 1 further comprising a vent box having a plurality of inlets connected to said plurality of supply hoppers.

9. The system of claim 1 further comprising a plurality of manifolds operably connected to each of said plurality of supply hoppers, a plurality of a spray guns operable in a plurality of spraying configurations and a purging configuration, and a plurality of air purge supplies, wherein each of said plurality of said manifolds comprises a plurality of outlets, wherein each of said plurality of said spray guns comprises a hose extending therefrom and terminating in an open end, wherein each of said hoses is associated with a corresponding one of said plurality of said manifolds and a corresponding one of said purge air supplies and is selectively, removably connected to at least one of said outlets of said corresponding manifold when in one of said plurality of said spraying configurations and wherein said spray gun is removably connected to said corresponding purge air supply when in said purging configuration.

10. The powder spray system of claim 1 wherein said open end of said hose is open to the ambient air when being moved between said at least one first connection and said second connection.

11. The powder spray system of claim 1 wherein said plurality of outlets each comprise a longitudinally extending tube defining a longitudinal direction, and wherein said open end of said hose is removeable from said at least one of said plurality of outlets along said longitudinal direction.

12. A method of operating a powder spray system comprising:

providing a plurality of supply hoppers each containing a powder and a manifold operably connected to each of said plurality of supply hoppers, said manifold comprising a plurality of outlets wherein each of said plurality of said outlets is associated with one of said plurality of said supply hoppers;

connecting an open end of a hose connected to a spray gun to one of said plurality of said outlets;

spraying said powder from said one of said supply hoppers associated with said one of said plurality of said outlets connected to said spray gun;

disconnecting said open end of said hose connected to said spray gun from said one of said plurality of said outlets, wherein said open end is free floating and free of any connection to said manifold;

connecting said open end of said hose connected to said spray gun to a purge air supply;

purging said spray gun with said purge air supply; and connecting said open end of said hose connected to said spray gun to another of said plurality of said outlets.

13. The method of claim 12 further comprising supplying air to a pump connected to said one of said supply hoppers associated with said one of said plurality of said outlets connected to said spray gun from said manifold through a plurality of air supply lines connecting said pump and said manifold.

14. The method of claim 13 further comprising supplying air to said manifold through at least one main air supply.

15. The method of claim 14 wherein said supplying said air from said manifold through a plurality of air supply lines comprises opening at least one of a plurality of valves corresponding to and operably connected to said plurality of said air supply lines, wherein said at least one main air supply communicates with at least one of said air supply lines when said at least one of said plurality of valves is opened.

16. The method of claim 12 further comprising a plurality of powder supply lines connecting said plurality of said supply hoppers and said manifold.

17. The method of claim 12 further comprising fluidizing each of said plurality of said supply hoppers and venting each of said plurality of said supply hoppers through a vent box having a plurality of inlets connected to said plurality of supply hoppers.

18. The method of claim 16 wherein said spraying said powder from said one of said plurality of said supply hoppers associated with said one of said plurality of said outlets connected to said spray gun comprises pumping said powder with a pump operably connected between said one of said plurality of said supply hoppers and said powder supply line connecting said one of said plurality of said supply hoppers and said manifold.

19. The method of claim 12 wherein said open end of said hose is open to the ambient air after said manually disconnecting said open end of said hose from said one of said plurality of said outlets and before said manually connecting said open end of said hose to said purge air supply.

20. The method of claim 12 wherein said plurality of outlets each comprise a longitudinally extending tube defining a longitudinal direction, and wherein said connecting said open end of said hose to one of said plurality of said outlets comprises moving said open end of said hose from a disengaged position along said longitudinal direction into engagement with one of said plurality of said tubes.

* * * * *